United States Patent [19]

Modrak et al.

[11] Patent Number: 4,798,757

[45] Date of Patent: Jan. 17, 1989

[54] SOFT WATER-PERMEABLE POLYOLEFIN NONWOVENS HAVING OPAQUE CHARACTERISTICS

[75] Inventors: James P. Modrak, Rockdale County; Owen P. Roberts, Franklin County, both of Ga.

[73] Assignee: Hercules Incorporated, Wilmington, Del.

[21] Appl. No.: 64,363

[22] Filed: Jun. 22, 1987

[51] Int. Cl.[4] ..... B32B 27/14

[52] U.S. Cl. ..... 428/198; 156/308.4; 428/286; 428/288; 428/296; 428/397

[58] Field of Search ..... 428/198, 286, 288, 296, 428/397; 156/308.4

*Primary Examiner*—Marion C. McCamish

*Attorney, Agent, or Firm*—John E. Crowe

[57] ABSTRACT

A method for controlling opacity, softness, and strength of polyolefin fiber-containing nonwoven material and the corresponding nonwoven material by utilizing at least 25%, based on web weight, of polyolefin filament (a) having an original spun denier not exceeding about 4 dpf, (b) having a final drawn denier of about 1.9–3.0 dpf, and (c) a delta cross-sectional configuration.

34 Claims, No Drawings

SOFT WATER-PERMEABLE POLYOLEFIN NONWOVENS HAVING OPAQUE CHARACTERISTICS

This invention relates to a method for increasing the opacity of polyolefin containing nonwovens and the corresponding materials, in which satisfactory levels of softness, CD strength and water permeability, are additionally retained without chemically changing the fiber or filament by controlling filament cross-sectional configuration.

BACKGROUND

Because of chemical inertness, low allergenic properties, high tensile strength and low melting point, polyolefin fiber and filaments, such as polypropylene are favored candidates for producing a variety of commercial products, particularly nonwoven products used in intimate contact with the human body.

In attempting to apply existing technology and material to meet competitive marketing needs, however, it is sometimes found that the cost and technical problems which arise far exceed the marketing advantages gained.

By way of example, nonwoven material used as cover sheets for diapers, sanitary napkins, and the like, must be cost competitive and retain substantial cross directional (CD) strength and energy (toughness) as well as the usual surface softness, short liquid strike through time, and limited rewetting properties.

Unfortunately, however, softness, absorbency, CD strength and the like are generally not compatible characteristics among synthetic nonwoven materials.

In particular, softness is usually gained in such material at the expense of lowered cross directional (CD) strength, and at a substantial increase in cost, figured on a Spun Weight/Time basis.

While the cross directional strength of such materials can usually be increased by increasing the bonding area and/or number of bonding loci, this is effected at the expense of necessary softness, feel, strike through and rewet properties.

In effect, therefore, the resulting nonwoven product represent a deliberate compromise, in which particular desirable characteristics are maximized and certain undesirable characteristics minimized, if possible, and accepted in exchange.

In the case of personal contact products such as diaper cover stock and the like, it is also found desirable to satisfy certain non-functional esthetic properties, such as increased opacity (preferably 32%–45%) and stain-masking ability to enhance marketability. In order to accomplish such further improvement, however, the difficulty in obtaining an acceptable compromise is greatly increased.

Generally, staining and opacity problems in synthetic nonwovens have been catagorized and treated in the art as unresolved coloring problems, which have been greatly complicated by the chemically inert nature of polyolefins such as polypropylene. For this reason colorants and brighteners are preferably introduced as spun melt components. This, in turn, has raised additional problems with respect to leaching, allergenic properties, CD strength loss, smaller spin quench windows, increased cost and the like.

It is an object of the present invention to increase the opacity of polyolefin-containing nonwoven material obtained from at least one web, without raising such added problems.

It is also an object of the present invention to minimize or avoid the need for high concentrations of colorants in nonwoven cover stock material to increase the opacity thereof.

THE INVENTION

The above objects are obtained in accordance with the present invention for increasing the opacity of nonwoven material comprising polyolefin filaments obtained from at least one web without substantial loss in CD strength or softness, by incorporating into one or more web of the material, an active amount of polyolefin filament having (a) delta cross-sectional configuration; (b) an initial spun denier not exceeding about 4 dpf; and (c) a final drawn denier of not less than about 1 dpf; and binding the web to obtain nonwoven material containing not less than about 25% of the polyolefin filament based on total web weight of the nonwoven material.

For present purposes the nonwoven material can comprise polyolefin filament of "Δ" cross section, alone or admixed with art-recognized polyolefin or other filaments such as rayon having cross-sectional configuration, such as "y", "x", "o" (round), or the like, including blends thereof in combination with fibrillated film such as polyolefin film. The particular combination and amount of filament of delta configuration will depend substantially upon the desired combination of characteristics.

Of particular interest, where a combination of softness and CD strength is desired, is the utilization of nonwoven material comprising polyolefin filament having both delta and round cross-sectional configuration present (a) as a uniform blend in each laminated web, or (b) in the form of a plurality of webs individually differing in concentration of delta cross-sectional configuration. Found particularly useful, in the instant invention, is the utilization of a ratio of delta-to-round cross-sectional configuration of about (25%–75%)-to-(75%–25%) and preferably about 50%-to-50% based on individual web weight or on total web weight, to achieve the desired total weight percent (in active amount) of delta cross-sectional component.

It is also found that delta cross-sectional polyolefin filament within the instant nonwoven material have a preferred initial spun denier within a range of about 2.0–4.0 dpf and a final drawn denier within the range of about 1.0–3.0 dpf (preferably 1.9–2.5 dpf), in order to retain both strength and softness. Generally, by use of the instant invention, one can achieve an opacity within the range of 32%–45% or even higher, depending ones one choice of ancillary characteristics.

Production techniques for obtaining the various polyolefin cross-sectional configurations found useful for purposes of the instant invention, and production of the nonwoven itself are well known in the art and not generally found to be part of the present invention.

It is possible, however, to obtain nonwoven materials having substantially improved opacity and stain-hiding properties without substantial sacrifice in other areas by using spun bonded, needle punched and particularly thermal or sonic bonded techniques utilizing webs in machine or cross directions to obtain materials as light as 15–30 gm/yd$^2$, provided the above-described parameters are observed. Cost-wise and weight-wise, however, thermal bonding is found to be a preferred fabrication technique.

For purposes of the present invention it is also found that the filament or fiber mix in the web preferably varies from about 1–3.0 inches in length, with CD tensile strength generally favoring use of filament or fiber at the longer end of the range, and optimum CD energy (toughness) favoring use of mixtures of long and short staple within the above range. For example, a 50:50 mixture of 1 inch delta with longer (e.g. 1.5"–2") round cross-sectional filament is found particularly useful in retaining strength and softness.

Nonwoven materials, as above described, can be readily utilized as cover stock for multi layered products such as diapers, sanitary napkins, and the like, in the manner produced and described, for instance, in U.S. Pat. Nos. 4,112,153, 4,391,869, 4,573,987, and 4,578,066 since CD strength, liquid absorption, strike through, rewet, softness, web uniformity, and line speed will not be seriously compromised.

The following examples and table further illustrate but do not limit the scope of the present invention.

EXAMPLE 1

A. Delta cross-sectional isotactic polypropylene filament of 4.0 dpf spun denier is produced in a conventional manner by melt spinning at 290° C. using PRO-FAX® 6501(*1) polypropylene polymer degraded in the usual way with 0.025% Lupersol to an MFR (Melt Flow Rate)*2A value of 16 and spun, using a 700 hole delta spinnerette to obtain a final drawn denier of 2.1 dpf. Crimped(*2) bundles are then cut into one inch (1") length, collected, and compressed into bales for later testing.

B. Round cross-sectional polypropylene filament of 2.8 dpf spun denier is similarly produced in a conventional manner by melt spinning PRO-FAX® 6501 polypropylene polymer degraded to an MFR value of 13, spun at 290° C. to obtain a final drawn denier of 2.1 dpf, crimped(*2), cut into 2 inch lengths, collected, compressed and baled for later testing.

C. Delta cross-sectional polypropylene of 2.6 dpf spun denier is produced by melt spinning at 285° C., using PRO-FAX 6301(*1), and finally drawn to 2.2 dpf, crimped(*2), cut into two inch (2") bundles, collected, compressed, and baled for later testing.

D. Delta cross-sectional fiber of Example 1A (2.1 dpf denier) is crimped (*2) and cut into 1.5 inch bundles collected and compressed into bales for later testing.

E. Round cross-sectional fiber of 2.8 dpf spun denier is drawn to 2.1 dpf as in Example IB, crimped (*2) and cut into 1.5 inch bundles, collected, and compressed into bales for later testing.

F. Staple cut fiber of delta and round cross-sectional configuration treated as described in C. and B. supra is combined in a homogeneous ratio of 50-to-50 parts by weight, collected, compressed and baled for later testing.

G. Round cross-sectional polypropylene filament of 1.5 dpf is produced in the manner of Example 1B by melt spinning PRO-FAX 6501 polypropylene polymer degraded to an MFR value of 12 at 285° C. and drawn to obtain a final drawn denier of 1 dpf, crimped (*2), cut into 1.5 inch lengths, collected, compressed and baled for later testing.

H. Delta cross-sectional polypropylene of 1.5 dpf spun denier is produced the manner of Example IC by melt spinning PRO-FAX 6501 at 285° C. and drawn to 1.0 dpf, crimped as before (*2), cut into 1.5 inch bundles, compressed, and baled for later testing.

I. Round cross-sectional polypropylene filament of 8.0 dpf is produced from the same melt and in the manner of Example IB, spun to obtain a 6 dpf final denier of, crimped (*2), cut into 1.5 inch lengths, collected, compressed, and baled for later testing. *1 Commercially available from Hercules Incorporated of Wilmington, Delaware *2 25 crimps/inch *2A ASTM D 1238-82

EXAMPLE 2

A. Baled one inch (1") crimped polypropylene staple of delta cross-sectional configuration as described in Example IA is broken, and formed into two identical homogeneous webs in a conventional manner, and the webs superimposed in machine direction as they are transferred onto a continuous fiber glass belt, and thermally bonded, using a hot diamond-patterned calendar at 165° C./40 psi roll pressure to obtain a nonwoven weighing 20gm/yd$^2$. The resulting material, identified as NW-1, is then cut into convenient dimensions for conventional testing purposes and test results reported in Table I below.

B. Baled two inch (2") crimped polypropylene staple of round cross-sectional configuration as described in Example IB is broken, and formed into two identical homogeneous webs in a conventional manner, the webs being superimposed in machine direction as they are transferred onto a continuous fiber glass belt, and thermally bonded as in Example 2A, using a hot diamond-patterned calendar to obtain a semi-opaque nonwoven weighing 20gm/yd$^2$. The resulting material, identified as NW-2, is then cut into convenient dimensions for testing purposes, standard tests run, and test results reported as control in Table I below.

C. The one inch (1") and two inch (2") crimped staple of delta and round configuration of Examples IA and IB is added to separate openers and conveyed into separate cards to form two homogeneous webs with a 25/75 weight ratio of 1" delta/2" round in a conventional manner, the webs being transferred onto a continuous fiber glass belt, and thermally bonded as before, using a hot diamond-patterned calendar to obtain a nonwoven material weighing 20.7gm/yd$^2$. The resulting material, identified as NW-3, is then cut into convenient dimensions for testing purposes, standard tests run, and test results reported in Table I below.

D. The one inch (1") and two inch (2") crimped staple of Examples IA and IB is added to separate openers, broken, conveyed into separate cards, and formed into two homogeneous webs having a 50/50 ratio of 1" delta/2" round in a conventional manner, the webs being superimposed in machine direction as they are transferred onto a continuous fiber glass belt, and thermally bonded as before, using a hot diamond-patterned calendar to obtain a nonwoven material weighing 20.7gm/yd$^2$. The resulting material, identified as NW-4, is then cut into convenient dimensions for testing purposes, standard tests run, and test results reported in Table I below.

E. The one inch (1") and two inch (2") crimped staple of Examples IA and IB is added to separate openers, broken and conveyed into separate cards and formed into two identical homogeneous webs of 1" delta and 2" round of 75/25 weight ratio in a conventional manner, the two webs being superimposed in machine direction, transferred onto a continuous fiber glass belt, and thermally bonded as before, using a hot diamond-patterned calendar to obtain a nonwoven material weighing 19.3gm/yd$^2$. The resulting material, identified as NW-5, is then cut into convenient dimensions for testing purposes, standard tests run, and test results reported in Table I below.

F. Baled combined two inch (2") crimped staple of 50:50 delta:round cross-sectional configuration by weight, as described in Example IF (1B and 1C) is broken and formed into two identical mixed fiber webs in the same general manner as before, the webs being superimposed in machine direction, transferred onto a continuous fiber glass belt, and thermally bonded as before, using a hot diamond-patterned calendar to obtain a nonwoven material weighing 19.1gm/yd$^2$. The resulting material identified as NW-6 is then cut into convenient dimensions for testing purposes, standard tests run, and test results reported in Table I below.

testing purposes, and test results reported in Table I below as a control.

I. Baled 1.5 inch polypropylene staple of delta cross-sectional configuration and 1 dpf from Example 1 2G supra to obtain an opaque nonwoven weighing about 20gm/yd$^2$. The resulting material, identified as NW-9, is then cut into convenient dimensions for testing purposes and test results reported in Table I below as a control.

J. Baled 1.5 inch (1.5") polypropylene staple of round cross-sectional configuration and a drawn dpf of 6 from Example 1 I is broken and formed into two identical homogeneous webs in the manner of as in Example 2H, to obtain a nonwoven, identified as NW-10, is then cut into convenient dimensions for testing purposes, and conventional test results reported in Table I below as a control.

TABLE 1

| Example | Material Sample | Bale From Ex. | Webs | Cross Section Δ:0 | Length (inches) Δ:0 | Opacity*4 in % | Feel*3A | CD*5 Dry (gms) |
|---|---|---|---|---|---|---|---|---|
| 2 A | NW-1 | 1A | Same | 100:0 | 1":0 | 41 | Coarse | 382 |
| 2 B*3 | NW-2 | 1B | Same | 0:100 | 0:2" | 26 | Excellent | 424 |
| 2 A/B | NW-3 | 1A<br>1B | Different | 25:75 | 1":2" | 32 | Excellent*7<br>Fairly Soft*6 | 447 |
| 2 A/B | NW-4 | 1A<br>1B | Different | 50:50 | 1":2" | 37 | Excellent*7 | 410 |
| 2 E | NW-5 | 1A<br>1B | Different | 75:25 | 1":2" | 39 | Fairly Soft*6 | 379 |
| 2 F | NW-6 | 1B<br>1C | Same | 50:50 | 2":2" | 35 | Soft | 454 |
| 2 G | NW-7 | 1D<br>1E | Different | 50:50 | 1.5":1.5" | 35 | Excellent*7 | 364 |
| 2 H*3 | NW-8 | 1G | Same | 0:100 | 0:1.5" | 42 | Excellent | 177 |
| 2 I*3 | NW-9 | 1H | Same | 100:0 | 1.5":1.5" | 44 | Soft | 234 |
| 2 J*3 | NW-10 | 1I | Same | 0:100 | 1.5":1.5" | 23 | Coarse (like polyester) | 304 |

*3Control.
*3A For evaluation purposes the term "Coarse" here denotes an unsatisfactory feel for commercial use as diaper coverstock and "Excellent" denotes a superior feel and softness acceptable for commercial usage, "Soft" denotes high quality commercially acceptable feel and softness while "Fairly Soft" denotes marginally acceptable feel and softness.
*4An opaqueness of 39% or above is here considered commercially superior as diaper coverstock and 32% considered a modest though significant improvement.
*5A CD dry strength of 300 gm or higher is considered commercially acceptable as diaper coverstock.
*6Tested for softness on the delta cross-sectional side.
*7Tested for softness on the circular cross-sectional side.

G. Baled 1.5 inch (1.5") crimped staple of drawn 2.1 dpf delta cross-section, as described Ex ID is broken and formed into a web in the same manner as before. A second web is then prepared using 1.5 (1.5") crimped staple of 2.1 dpf circular cross-section as described in Example IE is broken and formed into a web of equal weight in the same manner as before.

The two webs, consisting of different fiber cross-section are superimposed in a machine direction, transferred onto a continuous fiber glass belt, and thermally bonded as before, using a hot diamond-patterned calendar to obtain a nonwoven material weighing 18gm/yd$^2$. The resulting material identified as NW-7 is then cut into convenient dimensions for testing purposes, standard tests run, and test results reported in Table I below.

H. Baled 1.5 inch (1.5") polypropylene staple of round cross-sectional configuration (extruded 1.5 dpf drawn 1 dpf) as described in Example 1G is broken and formed into two identical homogeneous webs, the webs being superimposed in machine direction as they are transferred onto a continuous fiber glass belt then thermally bonded, using a hot diamond-patterned calendar at 165° C./40 psi roll pressure to obtain a nonwoven weighing 20gm/yd$^2$. The resulting nonwoven, identified as NW-8, is then cut into convenient dimensions for

What we claim and desire to protect by Letters Patent Is:

1. A polyolefin-containing nonwoven material comprising, in combination, at least one bonded fiber web, said nonwoven material containing not less than 25%, based on total web weight, of polyolefin filament having (a) a delta cross-sectional configuration, (b) and initial spun denier not exceeding about 4 dpf, and (c) a final drawn denier of not less than about 1 dpf.

2. A nonwoven material of claim 1, wherein said nonwoven material comprises polyolefin filament of delta and round cross-sectional configuration.

3. The nonwoven material of claim 2, wherein the material comprises polyolefin of filament having a ratio of delta-to-round cross-sectional configuration of about 50%:50% based on individual web weight.

4. The nonwoven material of claim 2, wherein polyolefin filament within the material has an initial spun denier within the range of about 2.0–4.0 dpf and a final drawn denier within the range of about 1.0–3.0 dpf.

5. The nonwoven material of claim 4, wherein the filament of delta cross-sectional configuration has a final drawn denier within the range of about 1.9–2.5 dpf.

6. The nonwoven material of claim 2, wherein the nonwoven is obtained by thermal bonding.

7. The nonwoven material of claim 2, wherein a blend of delta and round cross-sectional configuration is utilized in each web.

8. The nonwoven material of claim 7, wherein the material comprises polyolefin filament having a ratio of delta-to-round cross-sectional configuration of about (25%–75%)-to-(75%–25%), based on individual web weight.

9. The nonwoven material of claim 7, wherein the material comprises polyolefin filament having a ratio of delta-to-round cross-sectional configuration of about 50%-to-50% based on total web weight.

10. The nonwoven material of claim 7, wherein polyolefin filament within the material has an initial spun denier within the range of about 2.0–4.0 dpf and a final drawn denier within the range of about 1.0–3.0 dpf.

11. The nonwoven material of claim 10, wherein the filament of delta cross-sectional configuration has a final drawn denier within the range of about 1.9–2.5 dpf.

12. The nonwoven material of claim 7, wherein the nonwoven is obtained by thermal bonding.

13. The nonwoven material of claim 2, wherein a plurality of fiber webs are utilized, having different filament concentrations of delta cross-sectional configuration.

14. The nohwoven material of claim 13, wherein the material comprises polyolefin filament having a ratio of delta-to-round cross sectional configuration of about (25%–75%)-to-(75%–25%), based on total web weight.

15. The nonwoven material of claim 13, wherein polyolefin filament within the material has an initial spun denier within the range of about 2.0–4.0 dpf and a final drawn denier within the range of about 1.0–3.0 dpf.

16. The nonwoven material of claim 15, wherein the filament of delta cross-sectional configuration within each fiber web has a final drawn denier within the range of about 1.9–2.5 dpf.

17. The nonwoven material of claim 1, wherein the polyolefin filament within the material has an initial spun denier within the range of about 2.0–4.0 dpf and a final drawn denier within the range of about 1.0–3.0 dpf.

18. The nonwoven material of claim 17, wherein the polyolefin filament comprises polypropylene filament having a final drawn denier within the range of about 1.9–2.5 dpf.

19. The nonwoven material of claim 1, wherein the total web weight is within the range of 15–30 gm/yd$^2$.

20. The nonwoven material of claim 1, wherein the polyolefin filament has a length within the range of about 1"–2".

21. The nonwoven material of claim 1, wherein the polyolefin filament comprises polypropylene and having a length within the range of about 1"–2".

22. The nonwoven material of claim 1, wherein the nonwoven is obtained by thermal bonding.

23. A method for increasing the opacity of polyolefin-containing nonwoven material from at least one web, comprising incorporating as an initial component of said web, an active amount of a polyolefin filament having (a) delta cross sectional configuration;

(b) an initial spun denier not exceeding about 4 dpf; and (c) a final drawn denier of not less than about 1 dpf; and binding said web to obtain a nonwoven material containing not less than about 25% polyolefin filament of delta cross sectional configuration, based on total web weight of said nonwoven material.

24. A method of claim 23, wherein the nonwoven material comprises filament of mixed cross-sectional configuration.

25. A method of claim 24, wherein the polyolefin filament within the nonwoven material has an initial spun denier within the range of about 2.0–4.0 dpf and a final drawn denier within the range of about 1.0–3.0 dpf.

26. A method of claim 25, wherein the polyolefin filament is polypropylene filament having a final drawn denier within the range of about 1.9–2.5 dpf.

27. A method of claim 23 wherein a blend of polyolefin filament of delta and round cross-sectional configuration is utilized in each web.

28. A method of claim 27, wherein the nonwoven material comprises filaments having a ratio of delta-to-round cross-sectional configuration of about (25%–75%)-to-(75%–25%) by individual web weight.

29. A method of claim 27 wherein the nonwoven material comprises filaments having a ratio of delta-to-round cross-sectional configuration of about 50%-to-50% by individual web weight.

30. A method of claim 23 wherein the nonwoven material comprises a plurality of webs differing in concentration of delta cross-sectional configuration.

31. A method of claim 30, wherein the nonwoven material comprises filaments having a ratio of delta-to-round cross-sectional configuration of about (25%–75%)-to-(75%–25%) by total web weight.

32. A method of claim 30, wherein the nonwoven material comprises filaments having a ratio of delta-to-round cross-sectional configuration of about 50%-to-50% by total web weight.

33. A method of claim 23, wherein the polyolefin filament has an initial spun denier within the range of about 2.0–4.0 dpf and a final drawn denier within the range of about 1.0–3.0 dpf.

34. A method of claim 33, wherein the polyolefin filament is polypropylene filament having a final drawn denier within the range of about 1.9–2.5 dpf.

* * * * *

UNITED STATES PATENT AND TRADEMARK OFFICE

CERTIFICATE OF CORRECTION

PATENT NO. : 4,798,757

DATED : January 17, 1989

INVENTOR(S) : Modrak (James P.) and Roberts (Owen P.)

It is certified that error appears in the above-identified patent and that said Letters Patent is hereby corrected as shown below:

Column 2, line 54;

" ones " should read --upon--

Column 2, line 55;

" one " should read --one's--

Column 7, line 27 - Claim 14;

" nohwoven " should read --nonwoven-- .

Signed and Sealed this

Eighth Day of August, 1989

*Attest:*

*Attesting Officer*

DONALD J. QUIGG

*Commissioner of Patents and Trademarks*